US008272619B2

(12) United States Patent
Ernst et al.

(10) Patent No.: US 8,272,619 B2
(45) Date of Patent: Sep. 25, 2012

(54) WIRE GUIDE

(75) Inventors: Richard J. Ernst, San Diego, CA (US); John P. Grimm, Santee, CA (US)

(73) Assignee: Illinois Tool Works Inc., Glenview, IL (US)

( * ) Notice: Subject to any disclaimer, the term of this patent is extended or adjusted under 35 U.S.C. 154(b) by 232 days.

(21) Appl. No.: 12/712,826

(22) Filed: Feb. 25, 2010

(65) Prior Publication Data

US 2010/0219323 A1 Sep. 2, 2010

Related U.S. Application Data

(60) Provisional application No. 61/156,219, filed on Feb. 27, 2009.

(51) Int. Cl.
*F16M 13/00* (2006.01)

(52) U.S. Cl. ..... 248/544; 248/475.1

(58) Field of Classification Search ..... 248/544, 248/351, 542, 546, 475.1
See application file for complete search history.

(56) References Cited

U.S. PATENT DOCUMENTS

| | | | | |
|---|---|---|---|---|
| 1,973,018 | A * | 9/1934 | Shrimpton | 248/353 |
| 2,640,236 | A * | 6/1953 | Hume | 248/316.7 |
| 4,455,756 | A * | 6/1984 | Greene | 33/613 |
| 4,512,094 | A | 4/1985 | Seely | |
| 5,112,022 | A * | 5/1992 | Cardas | 248/493 |
| 5,129,154 | A * | 7/1992 | Aydelott | 33/613 |
| 5,409,276 | A * | 4/1995 | Engasser | 292/281 |
| 7,554,819 | B2 * | 6/2009 | Chen et al. | 361/826 |
| 7,730,626 | B2 * | 6/2010 | Charpentier | 33/407 |

FOREIGN PATENT DOCUMENTS

WO 2010006413 A1 1/2010

* cited by examiner

*Primary Examiner* — Anita M King

(74) *Attorney, Agent, or Firm* — Mark Croll; Patricia Chidiac; Beem Patent Law Firm

(57) ABSTRACT

An object-mounting aid such as a wire guide, comprising a first leg at a proximal end and a second leg at a distal end, with a hinge therebetween, wherein the second leg is longer than the first leg. The hinge may allow the second leg to pivot relative to the first leg so as to increase or decrease a gap between the second leg and the mounting surface, which may make it easier to position a wire on the second leg and may allow the second leg to serve as a ramp surface for the wire. The first leg includes a channel configured to receive and couple to a portion of a mounting device, e.g., by frictional engagement, which may be assisted through the use of detents on the guide. In addition, the guide may include a notch on the rear face of the first leg, the notch shaped so as to mirror or otherwise interface with at least a portion of the holder.

20 Claims, 4 Drawing Sheets

WIRE GUIDE

This application claims the benefit of U.S. provisional application 61/156,219, filed Feb. 27, 2009.

BACKGROUND OF THE INVENTION

1. Field of the Invention

The present invention is directed to an apparatus for aiding in mounting or hanging objects on a surface, e.g., to hanging wire-backed frames on hooks mounted on a wall.

2. Description of the Related Art

Wall mountable holders come in several varieties for different applications, including one-piece or multiple piece hooks, fasteners driven into wall anchors and nails or other fasteners driven directly into a substrate. Hooks generally have at least one upturned end spaced outwardly from the mounting substrate by a valley or channel. Similarly, fasteners such as screws and nails generally have an enlarged head extending from a smaller-diametered shank.

At times, mounting objects on these holders can be difficult because the object to be mounted obstructs vision of the holder such that a user must "guess" the location of the holder or move the object along the wall trying to locate the holder, increasing installation time and potentially marring the mounting surface. For example, picture frames sometimes include a mounting wire attached to the rear of the frame. Due to the size of the picture and the location of the hook in the center of the picture when properly installed, it often is difficult or impossible for the installer to see the holder and/or visually place the wire on the holder.

What is needed is an aid for mounting objects that avoids the drawbacks of traditional installations.

BRIEF SUMMARY OF THE INVENTION

In one aspect, an object-mounting aid such as a wire guide, comprising a first leg at a proximal end and a second leg at a distal end, with a hinge therebetween, wherein the second leg is longer than the first leg; and a plurality of arms on the first leg forming a plurality of channels extending rearward from the proximal end toward the hinge. The channels may be spaced apart for accommodating the upturned end of a mounting device and may have a thickness sized for accommodating the upturned end of a mounting device, e.g., by frictional engagement. In addition, the guide may comprise a plurality of second arms on the second leg that may be substantially aligned with the plurality of arms on the first leg. The guide also may have a notch between the plurality of arms and the second plurality of arms and proximate said hinge, such that the second leg may be adapted to pivot forward with respect to the first leg, and the second plurality of arms may be adapted to rest on the plurality of arms when a load is applied to a rear portion of the second leg, thereby supporting the second leg.

In another aspect, an object-mounting aid such as a wire guide, comprising a first leg having a front face and a rear face with a channel therebetween; a hinge along an upper end of the first leg; and a second leg extending upward away from the hinge; wherein the second leg is substantially longer than the first leg. The second leg may be between about 3 times and about 5 times longer than the first leg, preferably at least about 4 times longer. In addition, the guide may include an arcuate notch extending upward from a proximal end of the rear face and an arcuate notch extending upward from a proximal end of the front face.

In still another aspect, an object-mounting aid such as a wire guide, comprising a first leg and a second leg with a hinge therebetween, the first leg comprising a front face and a rear face, a distal end proximate the hinge and a proximal end, wherein the first leg includes a channel, open at the proximal end, between the front face and the rear face; and wherein the first leg includes a plurality of detents. The rear face may include an arcuate notch spaced from the proximal end by the detents, and the detents may be notches formed in the rear face. In addition, the detents may be arcuate and have proximal and distal ends extending toward a center of the rear face a greater amount than remaining portions of the detents, and the detents may have a radius of curvature between about 1/16" and about 1/8" for receiving a portion of a hook or other type of object holder. Detents may be sized so as to create an initial interference fit of between about 1/100" and about 5/100" when contacting holder, and the interference fit may be at least partially relieved as the guide is slid further over holder.

DETAILED DESCRIPTION

Figure 1:
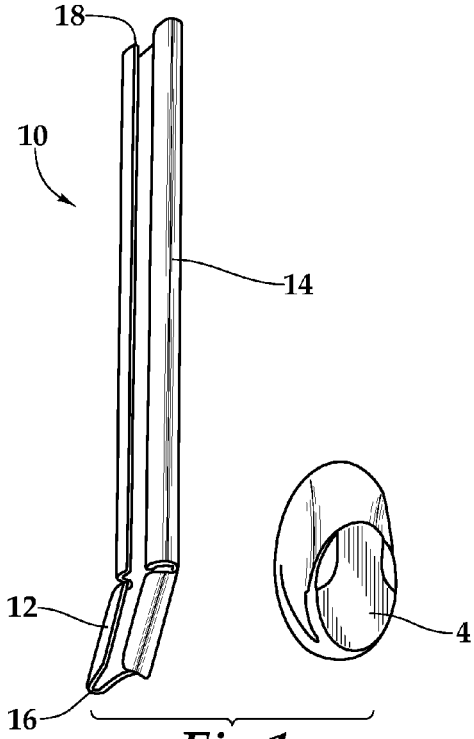
FIG. 1 is a side, perspective view of a wire guide for aiding in mounting objects to a surface, with one type of holder with which the wire guide may be used.

In one embodiment, a wire guide 10 for aiding in the mounting of an article 6 such as a wire-hung picture frame to a surface 2 using a holder 4 such as a hook. Guide 10 is an accessory device that can be installed onto the open end of a common picture hook, or a picture hook that is specifically designed to accept this accessory device. Additionally, guide 10 may be sized or otherwise adapted to engage the round head of a nail if the wire is hung directly from the nail instead of from a hook.

As seen in FIGS. 1-4, guide 10 may have a first leg 12 and second leg 14, the first leg 12 being shorter than second leg 14. First leg 12 may extend from proximal end 16, and second leg 14 may extend from distal end 18 and meet at hinge 20. Rear portion 22 of guide 10 may be a unitary structure such that hinge 20 may be a line of intersection, allowing first and second legs to fold with respect to each other. Alternatively, first and second legs may be separable such that hinge joins them together. Shorter first leg 12 may be between about ¼" and about 1¼" long, preferably between about ¼" and about 1" long, and in one embodiment about ⅝" long. Second leg 14 may be between about 2" long and about 5" long, preferably between about 2" long and about 3½" long, and in one embodiment about 2⅞" long. As such, guide 10 may have a total length of between about 2¼" long and about 6¼" long, preferably between about 2½" long and about 4¼ long, and in one embodiment, about 3½" long. In addition, rear portion 22 may be between about ¼" wide and about 1¼" wide, preferably between about ¼" wide and about 1" wide, and in one embodiment, about 0.6" wide.

First leg 12 may have a plurality of arms 24 extending forward and inward from rear portion 22 or edges 26 of first leg 12 so as to form a first channel 28 and an opposing second channel 30. Arms 24 and, therefore, channels 28, 30 may be similarly shaped such that first leg 12 is substantially symmetrical about axis. When used with a wall mountable hook, forwardly extending portion 32, 34 of arms 24 may extend from rear surface 22 between about 1/16" and about ¼", preferably between about 3/32" and about 3/16" and in one embodiment, about 0.14". Inwardly extending portion 36, 38 of arms 24 may then extend inward between about 1/16" and about half the width of the guide 10, preferably between about ⅛ and about half the width of the guide, and in one embodiment about 0.175". As such, there may be a gap 40 between the inward extending portions 36, 38 of between about 0" and about ¾ the width of the guide, preferably between about 0" and about ½ the width of the guide, and in one embodiment, about ¼". While arms 24 may have a separation so as to form a gap 40, arms 24 may be joined to one another so as to eliminate gap. In these instances, guide 10 may have a generally continuous perimeter with a hollow core, e.g., guide may be generally cylindrical or tubular.

Similarly, second leg 14 also may have a plurality of arms 42 extending forward and inward from edges 44 of second leg 14, and second leg 14 also may be substantially symmetrical about axis.

Elements of the guide 10, including the rear portion 22, the forwardly extending arm portions 32, 34, 46, 48 and/or the inwardly extending arm portions 36, 38, 50, 52 may have a thickness between about 1/64" and about ⅛", preferably between about 1/64" and about 5/64", and in one embodiment, about 0.04".

Figure 6:
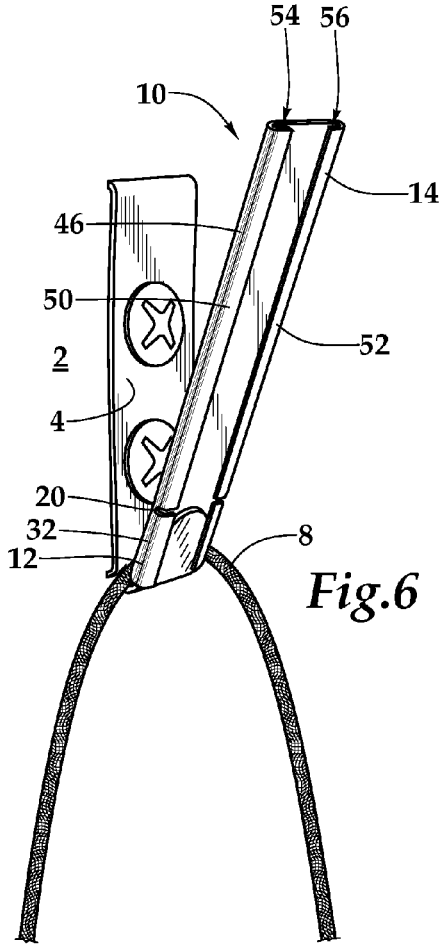
FIG. 6 is a perspective view of the wire guide and holder of FIG. 5 showing the wire in its resting position on the holder.
Figure 8:
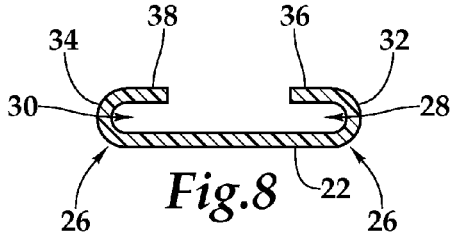
FIG. 8 is a section view through plane 8-8 of FIG. 2.
Figure 9:
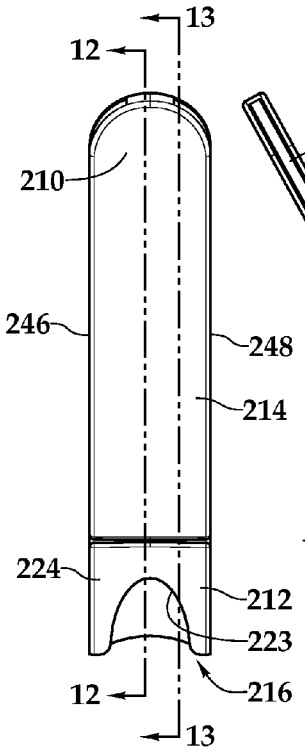
FIG. 9 is a front view of another embodiment of a wire guide for aiding in mounting objects to a surface.
Figure 10:
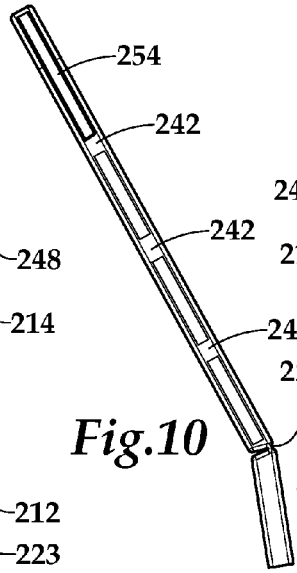
FIG. 10 is a side view of the wire guide of FIG. 9.
Figure 11:
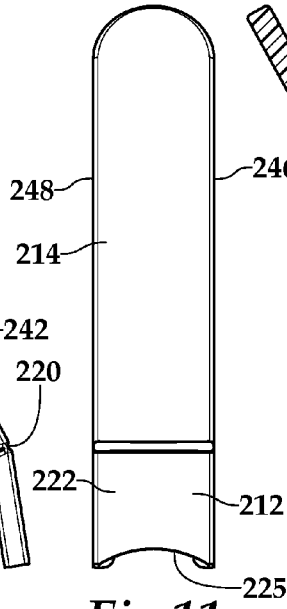
FIG. 11 is a rear view of the wire guide of FIG. 9.
Figure 12:
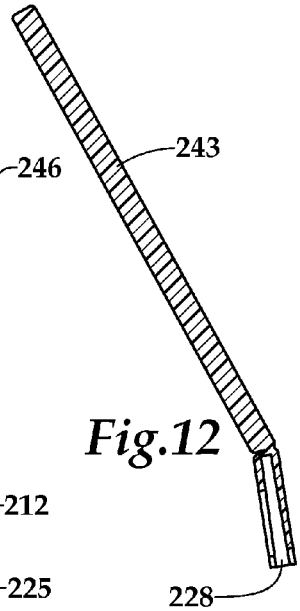
FIG. 12 is a section view of the wire guide through plane 12-12 of FIG. 9.
Figure 13:
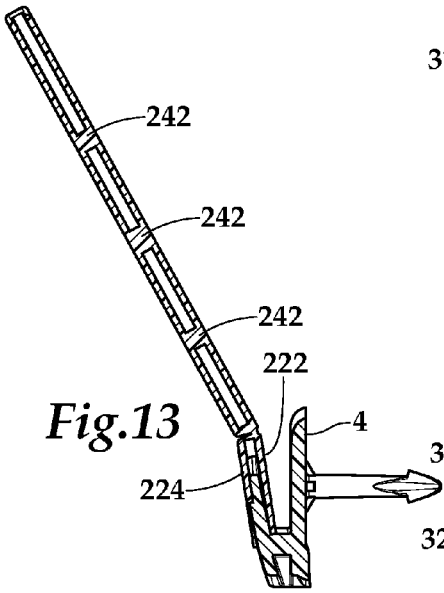
FIG. 13 is a section view of the wire guide through plane 13-13 of FIG. 9, also showing the guide mounted on a holder.
Figure 14:
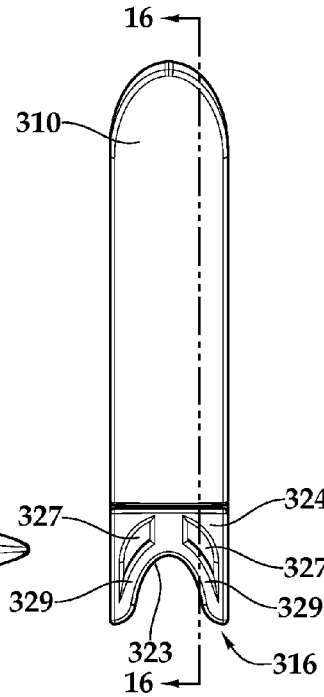
FIG. 14 is a front view of yet another embodiment of a wire guide for aiding in mounting objects to a surface.

Channels 28, 30 may be generally C-shaped, opening inward toward a center of guide, as seen in the cross-section view of FIG. 8. Channels 54, 56 on second leg also may be generally C-shaped, as seen in FIG. 6. Opening may be between about 1/32" wide and about ⅛" wide, preferably between about 1/32" and about 3/32" wide, and in one embodiment about 1/16" wide. Arms 24 may be similarly shaped to arms 42 such that channels may extend from first leg to second leg. In addition, arm ends 25 at proximal end 16 may be rounded or otherwise taper from edges 26 of guide to inwardly facing edges 36, 38 of arms 24.

Returning to FIG. 3, Guide 10 may have notches 58 between arms 24, 42 at hinge 20 so as to allow first leg 12 and second leg 14 to pivot with respect to one another. In addition, notches 58 may be generally perpendicular to rear portion 22. However, if so, notch surfaces 60, 62 are spaced apart to allow first leg and second leg to pivot inwardly with respect to one another to form an acute angle. Distance between notch surfaces 60, 62 may be between about 1/32" and about ⅛", preferably between about 0.06" and about 0.08". Alternatively or in addition, first and second notch surfaces may be angled toward each other to allow first leg 12 and second leg 14 to pivot in multiple directions. Each surface may be angle between about 10 degrees and about 60 degrees with respect to a plane perpendicular to rear portion, preferably between about 20 degrees and about 45 degrees, still more preferably between about 30 degrees and about 40 degrees.

The device is designed to protrude out from the front end of a picture hook 4, which is mounted on a wall 2, in such a way that it can easily "catch" the support wire 8 on the back of a framed picture, and guide the wire 8 into place on the hook 4. By having this device 10 angled outward from the wall 2 that the picture hook 4 is mounted on, the device 10 can easily "catch" the loose wire 8 as the picture 6 is slid down the face of the wall 2, as is commonly done when hanging large framed pictures. Once the wire guide device 10 catches or "snags" the loose wire 8 it is designed to guide the wire 8 into a resting place at the base of the picture hook 4.

In order to guide the wire 8 effectively, support the wire and avoid buckling, the guide 10 should be rigid in terms of bending outward from the wall 2 as the weight of the wire 8 and the framed picture 6 begin to bear on the outer end of the wire guide 10. Conversely, the guide 10 should be flexible and capable of hinging inward toward the wall 2 once the wire 8 is seated in the picture hook 4 and the framed picture 6 moves into place against the wall 2.

In one embodiment, the wire guide 10 device is a plastic molded or extruded part that is notched and bent at an angle. For example, the device may be made of polypropylene, polyethylene, polystyrene, nylon or acetal.

This angled long leg 14 of the wire guide 10 is the portion of the guide 10 that angles out from the wall 2 to "snag" the loose wire 8, i.e., to contain the wire 8 between the guide 10 and the wall 2 to ensure that the wire 8 reaches a final position on the mounting hook 4 without having to guess the location of the hook 4, which is obscured by the object 6 being mounted. The shorter leg 12 of the wire guide 10 provides a C-shaped configuration that can be positively mounted onto the end of the picture hook 4. In another embodiment, the shorter leg 12 may provide a smaller C-shaped configuration that may be positively mounted on the round head of a nail or other fastener.

Figure 5:
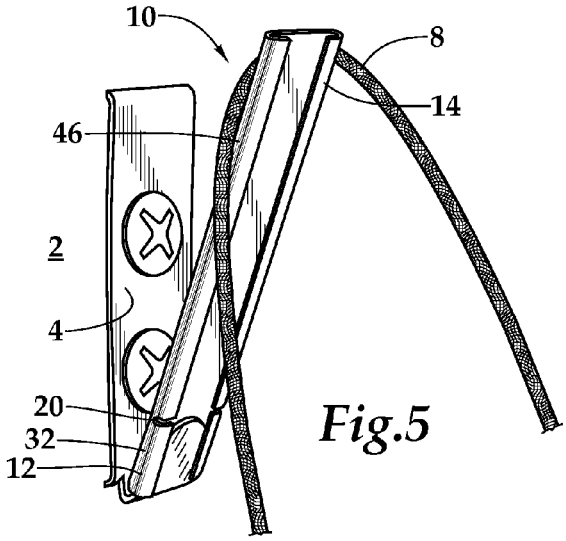
FIG. 5 is a perspective view of the wire guide installed on a second type of holder, just after loading on guide by a wire attached to the article to be hung.

In this initial bent position, the C-shaped profile of the long leg 14 bears against the C-shaped profile of the short leg 12, making a rigid, non-bending structure to positively guide the wire 8 into the hook 4, i.e., it provides a surface 22 along which the wire 8 may move toward the final resting position on the holder 4, as seen in FIG. 5.

Turning to FIG. 6, once the wire 8 is seated in the hook 4 and the picture 6 begins to move toward the wall 2, the wire guide 10 will flex or "hinge" at the angled bend 20 of the guide 10. This is facilitated by the notches 58 at the 2 sides of the C-shapes. At this point, the flat face 22 of the extruded plastic acts like a hinge. This allows the long leg 14 of the wire guide 10 to easily bend back toward the wall 2, as it is pushed by the weight of the picture 6 as it settled against the wall 2. The force applied to the long leg 14 may be represented by the arrow in FIG. 7.

Figure 7:
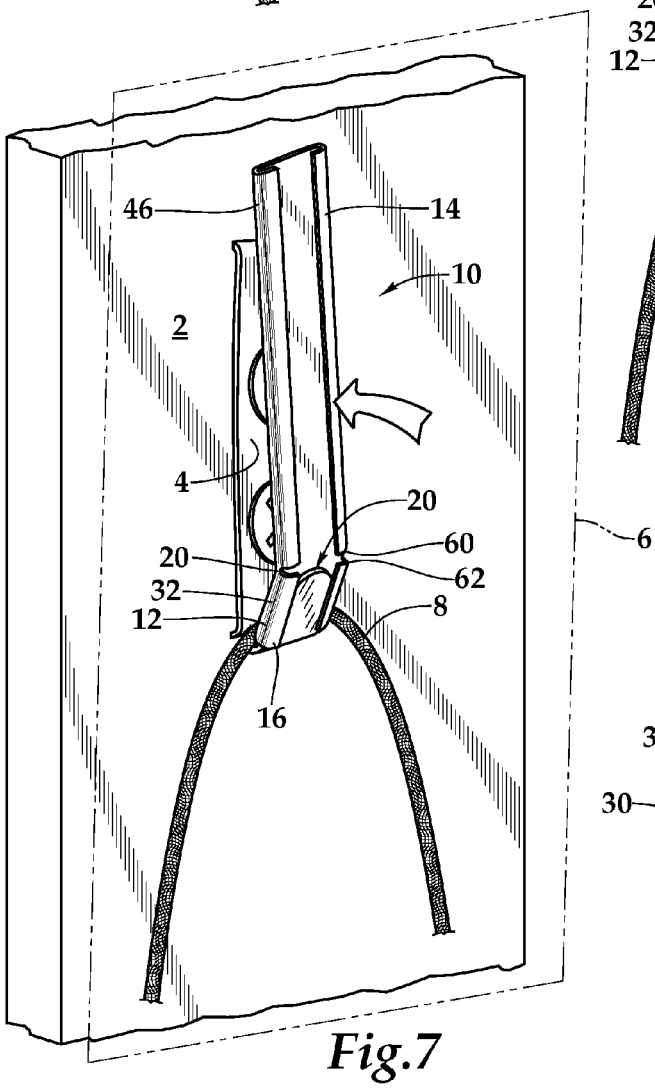
FIG. 7 is perspective view of the wire guide and holder of FIG. 5, simulating the orientation of the guide with respect to the mounting surface caused by the weight of the mounted article bearing on the guide.

Once the picture is settled into place against the wall, with the support wire fully engaged in the picture hook, the wire guide 10 may remain in place on the end of the picture hook 4, as in FIG. 7. This long extension on the front end of the picture hook can provide significant protection against the picture hook wire 8 jumping out of engagement with the picture hook 4, e.g., if the picture is struck or the picture is exposed to high vibration due to a seismic event.

Figure 2:
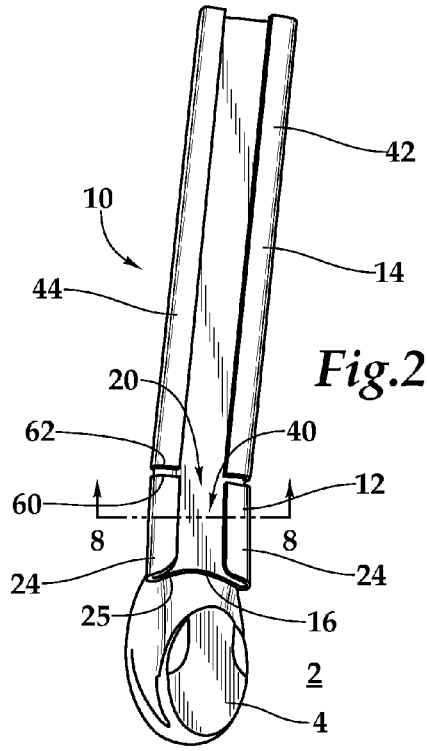
FIG. 2 is a front, perspective view of the wire guide and holder of FIG. 1 just prior to engagement of the guide with the holder.
Figure 3:
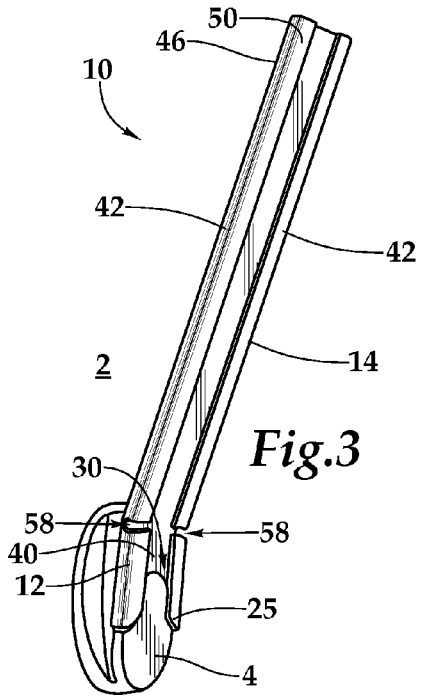
FIG. 3 is a perspective view of the wire guide installed on the holder.
Figure 4:
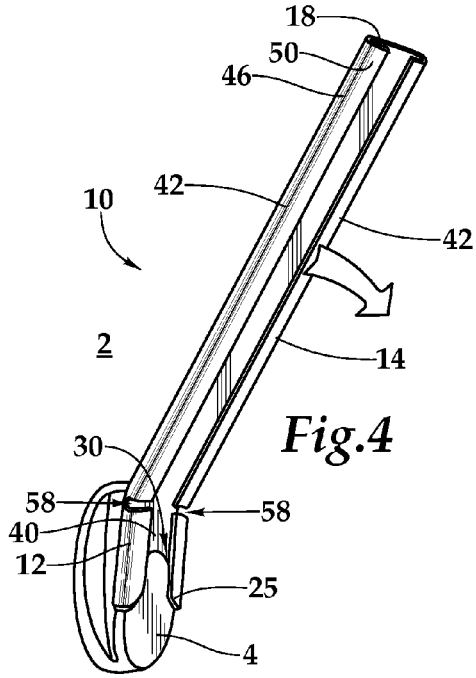
FIG. 4 is a perspective view of the wire guide being loaded away from the wall to simulate the weight of the wire and framed picture bearing on the wire guide.

On the other hand, if the wire guide 10 protrudes above the top of the framed picture 6, once the picture 6 is fully mounted on the wall 2, the top end 18 of the wire guide 10 can be grasped and pulled directly upward to completely remove it from engagement with the picture hook 4, as in FIG. 2. Once removed, the wire guide 10 can be discarded or re-used.

In another embodiment, the wire guide 110 may be formed as one piece with the holder 104, making the guide 110 a component of the picture hook itself instead of being a removable "accessory." For example, the upturned end of a hook 110 may be the same as the first leg 112. In this example, the upturned end portion 105 of the hook 104 may terminate at the hinge 120, with the pivoting second leg 114 or front "nose" extending therefrom. The "nose" of the integral wire guide 110 may be about the same size as a second leg 14 of a separate wire guide 10. However, since it would not be removable, the "nose" may be smaller to ensure it remains concealed behind a variety of differently-sized frames. Forming the guide 110 and holder 104 as a unitary structure may allow the guide 110 to perform the same function as when formed as a separate piece from the holder 104, i.e., providing the same stabilization and seismic preferences described above since the "nose" would be hinged back against the substrate 102 and stay there, and further may allow the holder 104 and guide 110 to be formed in a single step.

Turning to FIGS. 9-13, a third embodiment of a wire guide 210 is shown. Wire guide 210 may be similar to guide 10, and like numbering (with a 200s prefix) may apply to similar features. For example, guide 210 may have a first leg 212 and second leg 214 with a living hinge 220 therebetween. However, instead of each leg including arms separated by a gap, guide 210 may include a front face 224 extending substantially across a width of guide 210. Front face 224 may be generally parallel to rear face or portion 222 so as to form a channel 228 in first leg 212 between front face 224 and rear face 222. Injection molding may be beneficial in forming guide 210.

Second leg 214 may have a similar channel 254. Preferably, however, second leg 214 may include a plurality of inner ribs 242 extending inward from sides 246, 248. Ribs may be generally parallel to hinge 220, although other rib angles are possible. In addition, ribs may extend substantially from side 246 to 248 or, alternatively, second leg 214 may include another rib 243 centered along width of second leg 214 and extending generally along axis of symmetry of leg 214.

Proximal end 216 of first leg 212 may include notches on one or more of front face 224 and rear face 222. Notch 223 on front face 224 and notch 225 on rear face 222 may be generally arcuate. Notch 225 may be arced or semi-circular, e.g., to match a radius of curvature at the throat of a hook or the shank or head of a fastener. Conversely, notch 223 may be generally parabolic. In addition, top of notch 223 may extend away from proximal end 216 substantially farther than top of notch 225. However, widest portion of notch 225 may be narrower than hook or fastener so that hook, fastener, etc., may be maintained between rear face 222 and front face 224. Alternatively, notches may be similarly shaped or may have other configurations, as long as notches leave sufficient material on front face 224 and rear face 222 so as to capture a portion of holder 4 between those faces, as seen in the cross-section views of FIGS. 12 and 13.

Second leg 214 may be between about 2 times and about 6 times longer than first leg 212, preferably between about 3 times and about 5 times longer, still more preferably at least about 4 times longer. For example, in one embodiment, first leg 212 may have a length of about ⅝ inches, and second leg may have a length of about 2⅝ inches. In addition, both first and second legs may have a generally equal width, e.g., about equal to the length of first leg 212. Moreover, channel 228 between rear face 222 and front face 224 may be about equal to a thickness of a holder hook, fastener head, etc., so as to mount securely to hook, head etc. In one embodiment, channel 228 may have a thickness of about ⅛ inch.

In still another embodiment, as seen in FIGS. 14-17, wire guide 310 may be similar to guides 10 and 210, and like numbering (with a 300s prefix) may apply to similar features. Like guide 210, guide 210 may include a single channel 328 between rear face 322 and front face 324 for receiving hook or head of holder or fastener mounted to/in wall 2.

In this embodiment, front face 324 of guide 310 may include one or more openings 327 between notch 323 and hinge 320. Openings 327 may generally follow notch 323 so as to form one or more arcuate lands 329 between notch 323 and openings 327. As seen in the sectional view of FIG. 16, a portion of holder 4 may be retained between rear face 322 and front face 324, with lands 329 providing additional engagement surfaces for holder 4.

Guide 310 may have notches 323, 325 on front face 324 and rear face 322, respectively. Notches 323, 325 may be shaped similar to notches 223, 225 of guide 210. Alternatively, notch 325 may extend higher than notch 323, i.e., having an apex closer to hinge 320. Notch 325 may include portions extending generally parallel to sides 346, 348, as well as generally parabolic portions and other arcuate portions. Specifically, notch 325 may be provided with a shape designed to generally mirror the portion of holder 4 with which it may interface. This notch design also may be employed with the other guide embodiments described herein, and vice versa.

Figure 15:
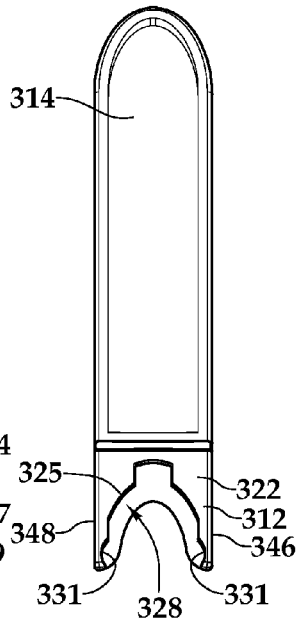
FIG. 15 is a rear view of the wire guide of FIG. 14.
Figure 16:
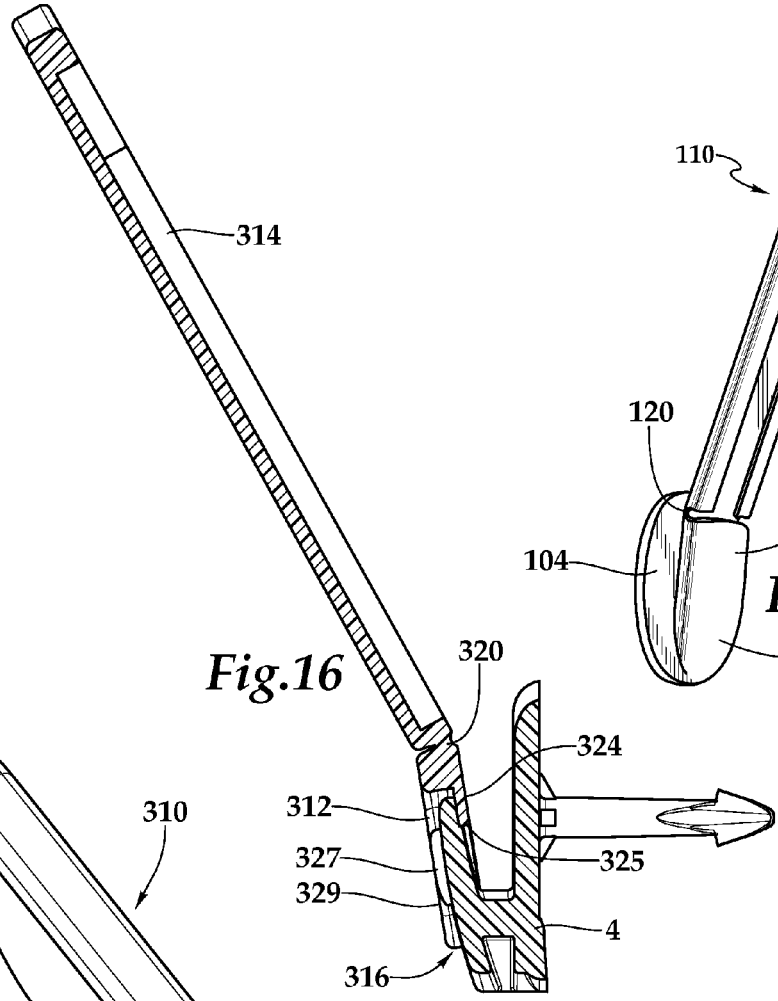
FIG. 16 is a section view of the wire guide through plane 16-16 of FIG. 14, also showing the guide mounted on a holder.
Figure 18:
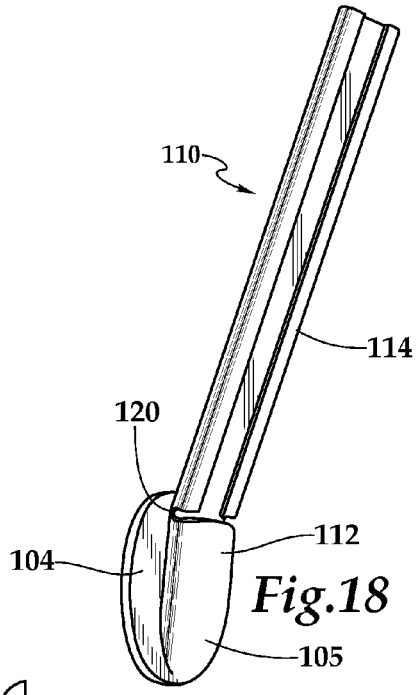
FIG. 18 is a perspective view of still another embodiment of a wire guide for aiding in mounting objects to a surface.
Figure 17:
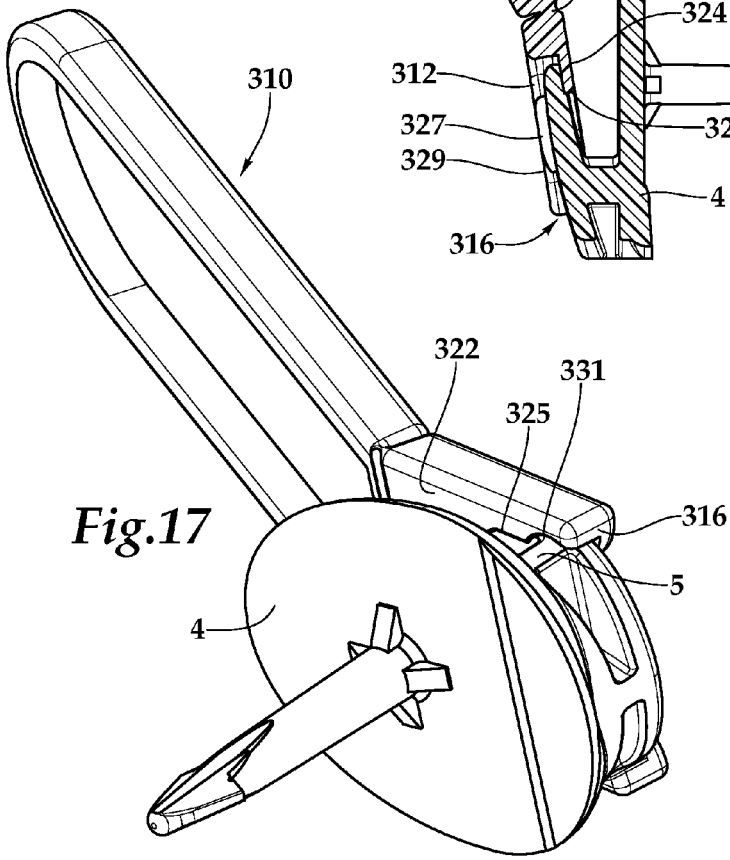
FIG. 17 is a rear, perspective view of a portion of the wire guide of FIG. 14, also showing the guide mounted on a holder.

Turning to FIGS. 15 and 17, guide 310 also may include one or more detents 331 on rear face 322. Detents 331 may be semicircular or other arcuate notches in rear face 322 beginning at or near proximal end 316 and extending upward along rear face 322, where they may intersect the ends of rear notch 325. When guide 310 is mounted on holder 4, width between detents 331 at a widest spot may be wider than width of an aligned portion 5 of holder 4. Additionally, width between detents 331 at proximal end 316 may be smaller than the same aligned portion of holder 4 such that detents 331 may extend over portion 5 of holder to positively engage guide 310 with holder 4. Detents 331 may have proximal and distal ends extending toward a center of the rear face 322 a greater amount than remaining portions of the detents, and the detents may have a radius of curvature between about 1/16" and about ⅛" for receiving aligned portion 5 of a hook or other type of object holder 4. Detents may be sized so as to create an initial interference fit of between about 1/100" and about 5/100", and in one embodiment about 14/1000" when contacting aligned portion 5, and the interference fit may be at least partially relieved as the guide 310 is slid further over holder 4.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. An object-mounting aid, comprising:

a first leg at a proximal end and a second leg at a distal end, with a hinge therebetween, wherein the second leg is longer than the first leg; and a plurality of arms on said first leg forming a plurality of channels extending rearward from said proximal end toward said hinge;

wherein said first leg includes a first surface proximate said hinge, and said second leg includes a second surface also proximate said hinge, where said surfaces are configured to bear against one another during use.

2. An object-mounting aid according to claim 1, wherein said channels are spaced apart for accommodating an upturned end of a mounting device.

3. An object-mounting aid according to claim 1, wherein said channels have a thickness sized for accommodating an upturned end of a mounting device.

4. An object-mounting aid according to claim 3, wherein said channels are sized for frictionally engaging the upturned end of said mounting device.

5. An object-mounting aid according to claim 1, further comprising a plurality of second arms on said second leg substantially aligned with said plurality of arms on said first leg.

6. An object-mounting aid according to claim 5, further comprising a notch between said plurality of arms and said second plurality of arms and proximate said hinge.

7. An object-mounting aid according to claim 6, wherein said second leg is adapted to pivot forward with respect to said first leg and said second plurality of arms is adapted to rest on said plurality of arms when a load is applied to a rear portion of said second leg, thereby supporting said second leg.

8. An object-mounting aid according to claim 1, wherein said aid is injection molded.

9. An object-mounting aid, comprising:

a first leg having a front face and a rear face with a channel therebetween;

a hinge along an upper end of said first leg; and a second leg extending upward away from said hinge, said second leg having a front face and a rear face with a channel therebetween;

wherein said front faces on said first and second legs are substantially aligned;

wherein said second leg is substantially longer than said first leg; and wherein said aid is mountable and dismountable from an object holder.

10. An object-mounting aid according to claim 9, wherein said second leg is between about 3 times and about 5 times longer than said first leg.

11. An object-mounting aid according to claim 9, wherein said second leg is at least about 4 times longer than said first leg.

12. An object-mounting aid according to claim 9, further comprising an arcuate notch extending upward from a proximal end of said rear face.

13. An object-mounting aid according to claim 9, further comprising an arcuate notch extending upward from a proximal end of said front face.

14. An object-mounting aid, comprising:

a first leg and a second leg with a hinge therebetween;

said first leg comprising a front face and a rear face, a distal end proximate said hinge and a proximal end;

wherein said first leg includes a channel, open at said proximal end, between said front face and said rear face; and wherein said first leg includes a plurality of detents.

15. An object-mounting aid according to claim 14, wherein said rear face includes an arcuate notch spaced from said proximal end by said detents.

16. An object-mounting aid according to claim 14, wherein said detents are notches formed in said rear face.

17. An object-mounting aid according to claim 14, wherein said detents are arcuate and have proximal and distal ends extending toward a center of said rear face a greater amount than remaining portions of said detents.

18. An object-mounting aid according to claim 14, wherein said detents create an initial interference fit with a holder of between about 1/100" and about 5/100".

19. An object-mounting aid according to claim 14, wherein said front face includes an arcuate notch at said proximal end.

20. An object-mounting aid according to claim 14, wherein said aid is injection molded.

* * * * *